US005801735A

United States Patent [19]

Lorenze, Jr. et al.

[11] Patent Number: 5,801,735

[45] Date of Patent: *Sep. 1, 1998

[54] AUTOMATED SYSTEM FOR REFILLING INK JET CARTRIDGES

[75] Inventors: Robert V. Lorenze, Jr., Webster; Renato P. Apollonio, Rochester, both of N.Y.

[73] Assignee: Xerox Corporation, Stamford, Conn.

[ * ] Notice: The term of this patent shall not extend beyond the expiration date of Pat. No. 5,663,754.

[21] Appl. No.: 524,355

[22] Filed: Sep. 5, 1995

[51] Int. Cl.[6] ..... B41J 2/175

[52] U.S. Cl. ..... 347/85

[58] Field of Search ..... 347/29, 30, 36, 347/84, 85, 86, 87

[56] References Cited

U.S. PATENT DOCUMENTS

| | | | |
|---|---|---|---|
| Re. 32,572 | 1/1988 | Hawkins et al. | 156/626 |
| 4,383,263 | 5/1983 | Ozawa et al. | 347/30 |
| 4,422,084 | 12/1983 | Saito | 347/86 |
| 4,558,326 | 12/1985 | Kimura et al. | 347/30 |
| 4,628,333 | 12/1986 | Terasawa | 347/87 |
| 4,631,556 | 12/1986 | Watanabe et al. | 347/30 |
| 4,638,337 | 1/1987 | Torpey et al. | 347/65 |
| 4,774,530 | 9/1988 | Hawkins | 347/63 |
| 4,968,998 | 11/1990 | Allen | 347/7 |
| 5,136,305 | 8/1992 | Ims | 347/7 |
| 5,199,470 | 4/1993 | Goldman | 141/1 |
| 5,280,299 | 1/1994 | Saikawa et al. | 347/87 |
| 5,325,111 | 6/1994 | Dietl | 347/30 |
| 5,329,294 | 7/1994 | Ontawar et al. | 347/87 |
| 5,365,645 | 11/1994 | Walker et al. | 29/25.35 |
| 5,369,429 | 11/1994 | Erickson | 347/7 |

*Primary Examiner*—N. Le

[57] ABSTRACT

A system is provided for refilling an ink reservoir associated with an ink jet printhead. The printhead is mounted on a movable carriage which, when refill is needed, and in a first embodiment, is automatically moved to a refill station. At the refill station, a refill ink source is brought into sealing engagement with the front nozzle face of the printhead. Ink from a refill container is forced into the printhead nozzles and flows through the nozzle channels back into the reservoir. The refill operation is then enabled by establishing a pressure gradient against the refill ink container forcing it through a pressure regulating drive seal, or a filter, into the nozzles. Alternatively, a vacuum is established through a vent tube connecting into the cartridge reservoir creating a negative differential at the vent hole and causing the ink from the refill container to pass through the nozzles into the supply reservoir. In another embodiment, a maintenance station wherein the printhead nozzles are periodically primed is selectively converted into a refill station under control of a system controller.

6 Claims, 6 Drawing Sheets

AUTOMATED SYSTEM FOR REFILLING INK JET CARTRIDGES

BACKGROUND OF THE INVENTION AND MATERIAL DISCLOSURE STATEMENT

The present invention relates to an ink jet printer system and, more particularly, to an automated system for refilling an ink jet cartridge which supplies ink to an ink jet printhead.

Ink jet printers, or plotters, of the so-called "drop-on-demand" type have at least one printhead from which droplets of ink are directed towards a recording medium. Within the printhead, the ink is contained in a plurality of channels and energy pulses are applied to transducers to cause the droplets of ink to be expelled, as required, from nozzles at the ends of the channels.

In a thermal ink jet printer, the energy pulses are usually produced by resistors, which are individually addressable by current pulses to heat and vaporize ink in a channel or recess proximate to the nozzle. As a vapor bubble grows, ink bulges from the nozzles until the current pulse has ceased and the bubble begins to collapse. At that stage, the ink within the channel or recess retracts and separates from the bulging ink which forms a droplet moving in a direction away from the nozzles and towards the recording medium. The channel or recess is then re-filled by capillary action, which in turn draws ink from a supply cartridge. Operation of a thermal ink jet printer wherein the ink is expelled from channels is described in, for example, U.S. Pat. Nos. 4,638,337 and 4,774,530, which disclose a printer of the carriage type having a plurality of printheads, each with its own ink supply reservoir, mounted on a reciprocating carriage. The nozzles of each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

Many current ink jet printers and plotters utilize disposable printhead cartridges which incorporate self-contained ink supplies. However, the current printhead technology has advanced to the point where the lifetime and reliability of the structural components of the printhead, such as the resistive heater elements, far exceed the usage life of the self-contained ink supply. For example, for a Xerox 4004 printhead, the standard ink charge will last for $5\times10^6$ pulses per jet while the heater reliability includes minimum lifetimes in excess of $5\times10^7$ pulses per jet. Thus, it is seen that discarding an ink cartridge supply because it's ink charge has been expended is wasteful and environmentally unfriendly.

The need for refilling ink jet cartridges to exceed lifetime is therefore well recognized and several methods and devices have been presented to accomplish this. One approach is to connect a second auxiliary ink reservoir to a main printhead cartridge to provide a continuous resupply during operation. U.S. Pat. No. 5,369,429 discloses this technique.

Other techniques are directed to removing the ink cartridge from the system and refilling through either an already existing vent hole by means of an ink-filled syringe or by using a special tool to form a new, or enlarge an existing, vent hole. The cartridge is then refilled by means of a tube or syringe from an auxiliary supply. Disclosures of this type of refill are found in U.S. Pat. Nos. 5,199,470 and 5,329,294.

U.S. Pat. No. 4,968,998 discloses refill of a cartridge without removing the cartridge from the printhead by moving the printhead to a service station and inserting a refill tube into an aperture in the cartridge body.

The above techniques are not suitable for many types of printheads and printing systems. For example, many cartridges contain the ink in a collapsible bag so penetration of the cartridge with a syringe or refill tube would puncture the bag. Further, some ink cartridges have venting tubes which are either inaccessible or which, once modified, must be restored for the original venting purpose. It would also be desirable to perform refill operations without the necessity of manually removing the cartridge from the printer.

SUMMARY OF THE INVENTION

It is an object of the present invention to provide a system for refilling ink jet cartridges with different types of ink-holding interior receptacles.

It is a further object to enable an automated cartridge refill system.

It is a further object to refill a cartridge either at an independent refill station or at a maintenance station which has been modified to include a refill operation without the need to manually remove the cartridge.

These and other objects of the invention are realized by automatically moving a printhead cartridge into a refill station and establishing a refill operation through the nozzle face of the printhead. A source of refill ink is sealingly attached to the printhead nozzle face. A vacuum or a pressure is applied to force the refill ink through the nozzles and back into the ink supply. In one embodiment, the printhead cartridge is moved to a dedicated refill station outside the normal print zone and an ink cartridge is refilled through the printhead nozzles from a refill reservoir by applying a pressure differential. Alternately, the cartridge, at the dedicated station, is refilled through the printhead nozzles by a vacuum mechanism. In another embodiment, the printhead cartridge is moved to a maintenance station outside the print zone which has been modified to incorporate a refill capability. The cartridge is refilled by either of the two methods described above.

More particularly, the present invention relates to an ink refill system for an ink jet printer comprising:

- an automated system for refilling ink jet cartridges in an ink jet printing system wherein a printhead and associated ink supply reservoir comprising the cartridge are moved on a carriage through a print zone with ink being ejected from nozzles formed in a nozzle face of the printhead, the system further including:
  - means for moving said cartridge to a refill station located outside of said print zone,
  - means at said refill station, for sealingly engaging an ink refill reservoir with said nozzle face,
  - means to force ink from said refill reservoir through said printhead nozzles and into the associated ink supply reservoir thereby refilling said reservoir and
  - means for returning said cartridge to a print or maintenance location.

DESCRIPTION OF THE INVENTION

Figure 1:
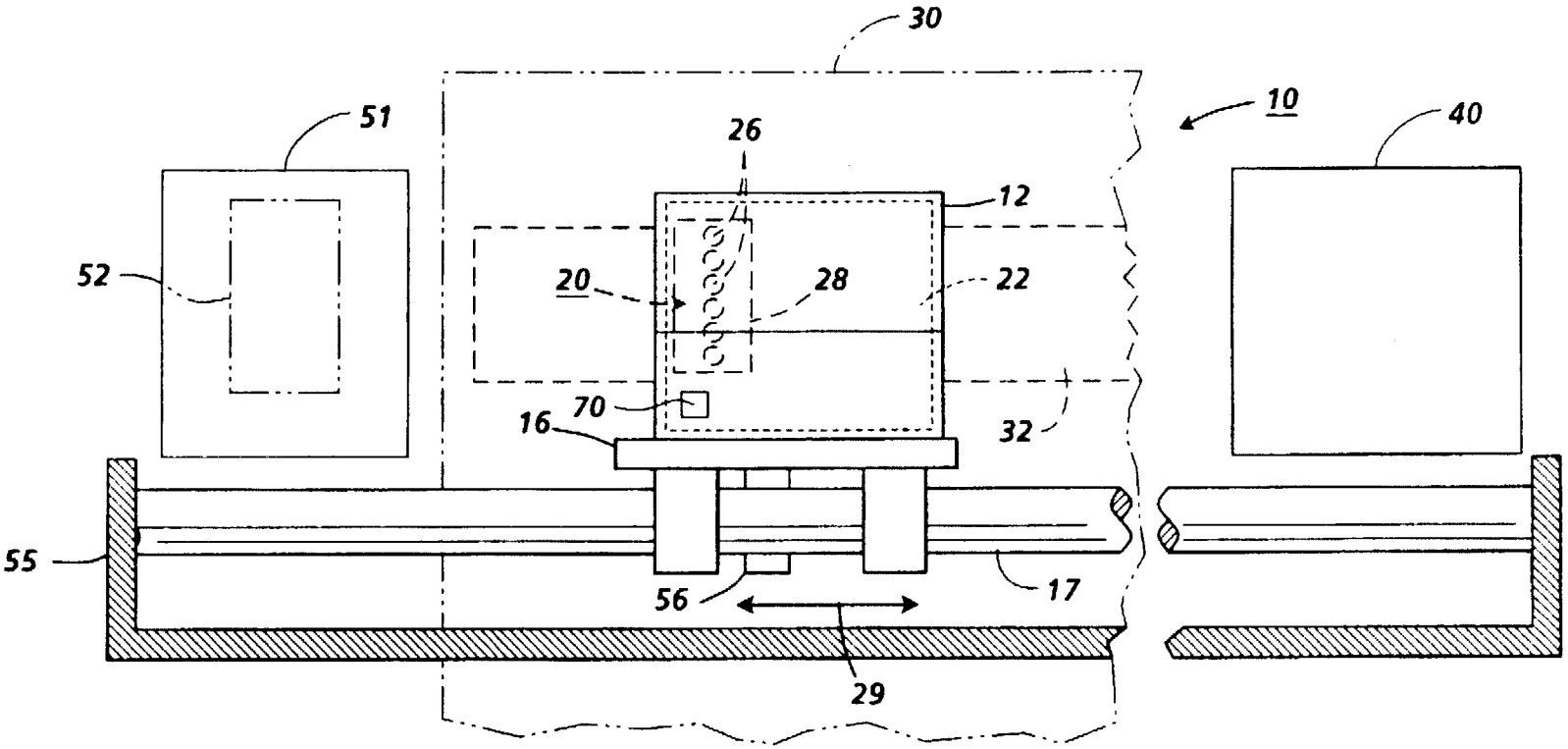
FIG. 1 is a schematic view of an ink jet printing system incorporating a first embodiment of a separate dedicated cartridge refill station.

FIG. 1 shows an embodiment of a thermal ink jet printer 10 in which the refill system of the present invention can be utilized. Printer 10 includes a printhead cartridge 12 mounted on a scanning carriage 16, translatable back and forth on guide rails 17 via a motor-driven lead screw (not shown). Cartridge 12 comprises a printhead 20 and an integral ink supply reservoir 22, which can be filled with ink or with an ink impregnated foam material. Formed within the printhead are a plurality of ink channels, each with a resistive heater, continuously supplied with ink from the reservoir through a printhead fill hole. The ink channels terminate in nozzles 26 in nozzle face 28.

Figure 2:
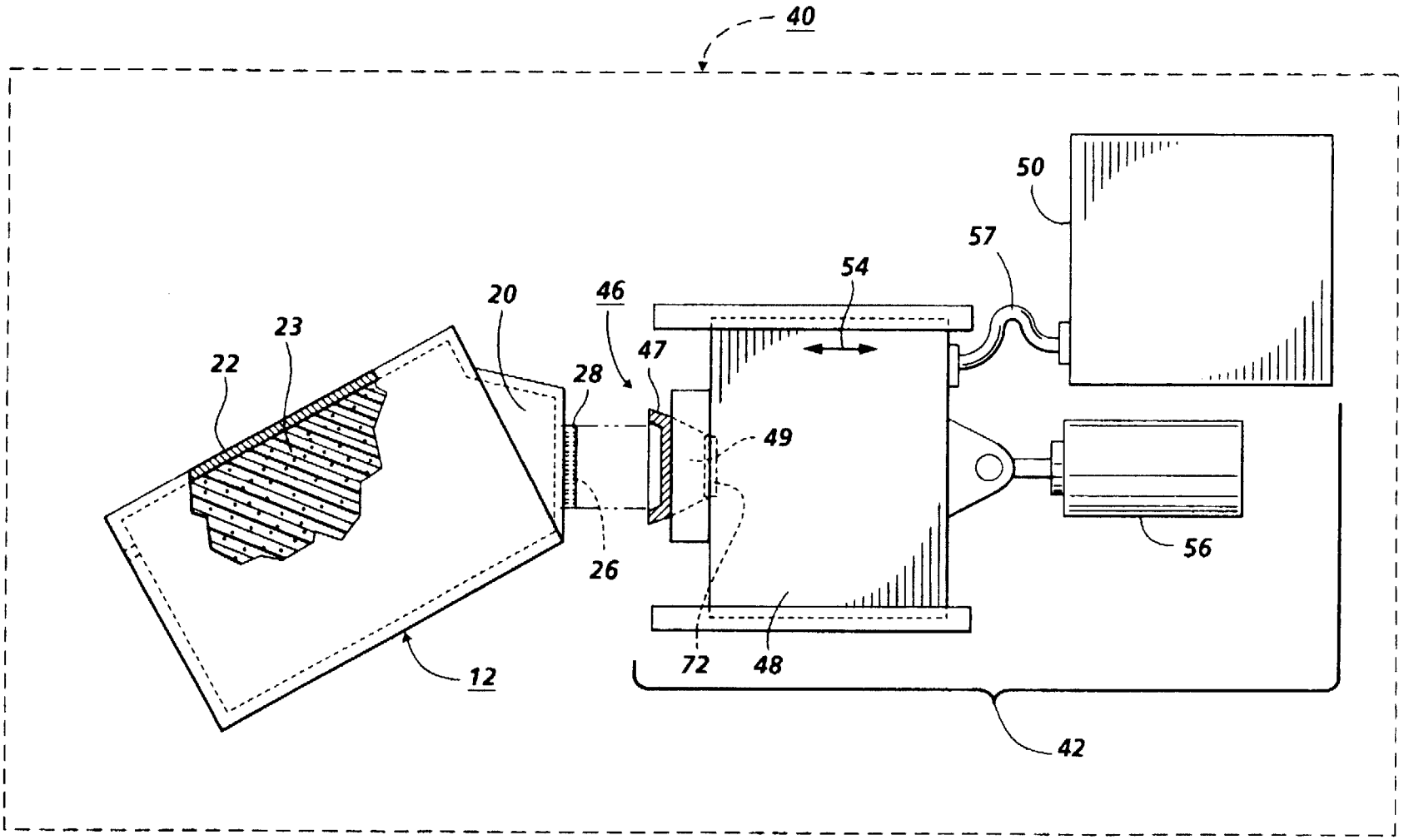
FIG. 2 is a schematic end view of the printing cartridge at the refill station of FIG. 1.

Referring to FIGS. 1 and 2, a refill station 40, described in further detail below, is positioned at one side of the printer outside the print zone. Optionally, at the other side of the print zone is a maintenance station 51 which includes at least a capping/priming assembly 52. Maintenance station 51 is of the type disclosed in U.S. Pat. No. 5,325,111, whose contents are hereby incorporated by reference.

In response to a "initiate refill" signal generated as described below, scanning carriage 16 is moved along rail 17 to a refill position in station 40 confronting a refill assembly 42. The carriage is conveyed to the refill position by conventional actuator means of the type disclosed in the 5,325,111 patent, referenced supra. Assembly 42, which is located in the printer so as to be accessible to a user through the top cover, comprises a sealing assembly 46, a refill ink container 48, a pressure pump 50 and a solenoid 56. As shown in FIG. 2, assembly 46 is movable towards and away from printhead 12 as indicated by arrow 54 by, for example, solenoid 56 acting on container 48. Sealing assembly 46 comprises a gasket 47 which can be a molded elastomer material such as silicon which, under pressure following solenoid 56 activation, forms a leak-proof seal with the nozzle face 28 of the printhead. Assembly 46 also includes a filter 49. Container 48 holds the desired volume of refill ink (typically 40–60 ml). A short length of flexible tubing 57 connects the pump 50 to the ink container 48.

Figure 3:
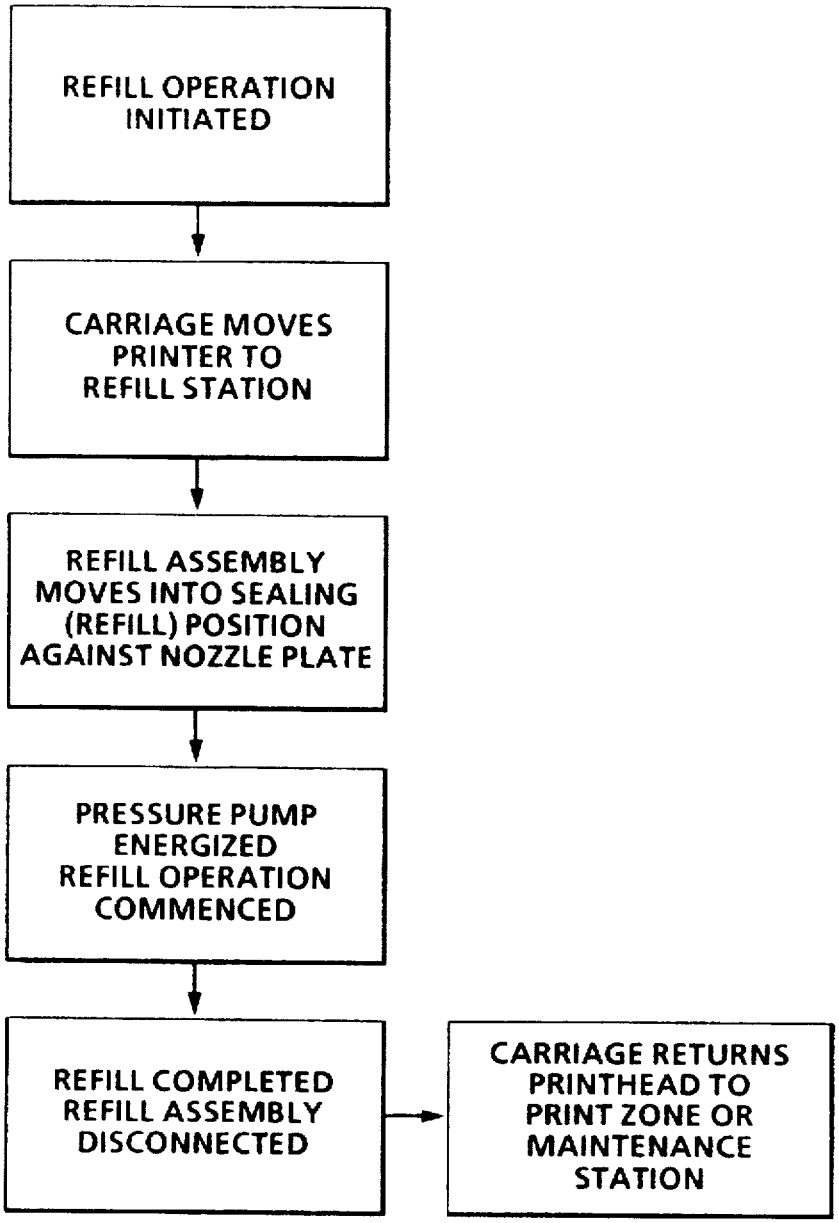
FIG. 3 is a flow diagram of a refill operation.
Figure 4:
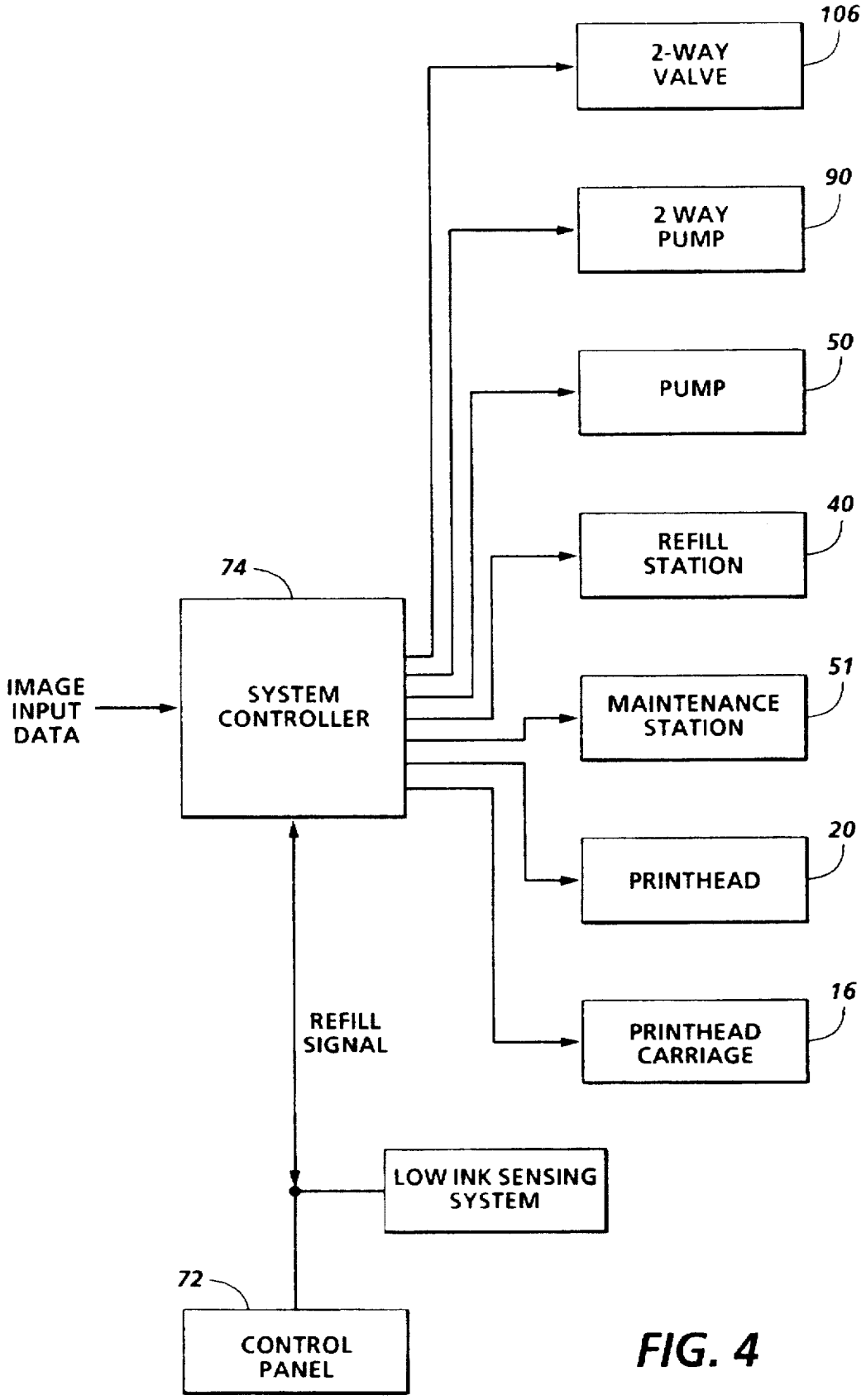
FIG. 4 is a block diagram of the control system for controlling the operation of the printer of FIG. 1 and the refill operation.

In operation and referring to FIGS. 1, 2, the ink flow chart of FIG. 3 and a control diagram of FIG. 4, a decision is made to initiate a refill operation. This may be made by an operator or automatically, for example, by an ink level sensing system which generates a signal to create a display on a control panel 72 indicating that ink refill is required. An exemplary sensing system is disclosed in U.S. Pat. No. 5,136,305, whose contents are hereby incorporated by reference. Assuming an operator initiates the sequence, the operator makes a selection at control panel 72 to initiate a reservoir refill operation and fills reservoir 48 with ink. The refill operation is controlled by circuitry contained within the controller 74 (FIG. 4). Carriage 16 moves along rail 17 until the printhead nozzle plate 28 is aligned with the refill assembly 42 as shown in FIG. 2. The sealing assembly 46 is moved in the direction of arrow 54 by activation of the solenoid upon signals from the system controller. A biasing mechanism of the type described in copending application U.S. Ser. No. 07/976,133 to seal a capping mechanism to a printhead nozzle face may be employed to obtain required sealing pressure. Contents of this '133 application are hereby incorporated by reference. Pressure pump 50 is then activated, and ink is forced from reservoir 48 through filter 49 and into nozzles 26. (Alternatively, filter 49 may be replaced by an aperture plate or by another pressure regulating mechanism to prevent gasket seal leaks from developing and to control gas bubbles from being introduced into the cartridge.) In one controlled experiment, a pressure of about 1–2 psi was applied against the ink in container 48. Within one minute, 60 mm of ink flowed from the container through the nozzles and into reservoir 22.

As ink begins to flow from container 48 through nozzles 26, the ink flows in a path opposite to the capillary flow of ink during normal operation; e.g. the ink flows through ink channels and begins to refill reservoir 22. The refill operation continues until the reservoir is filled to the desired level at which time pump 50 is de-energized. Solenoid 56 is then de-energized and assembly 42 is then moved out of sealing engagement with the printhead nozzle face 28. The carriage is moved to the left in FIG. 1 to restore the printhead to the normal operating location or the carriage can be moved to maintenance station 51 for a standard prime/wipe cycle and capping.

To summarize this first embodiment of the refill system of the present invention, a printhead, is moved to a refill station where an ink refill assembly is brought into a sealing relationship with the nozzle face of the printhead. Ink from a refill reservoir is introduced into the printhead reservoir via the nozzles using a pressure mechanism to create the reverse ink flow.

Figure 5:
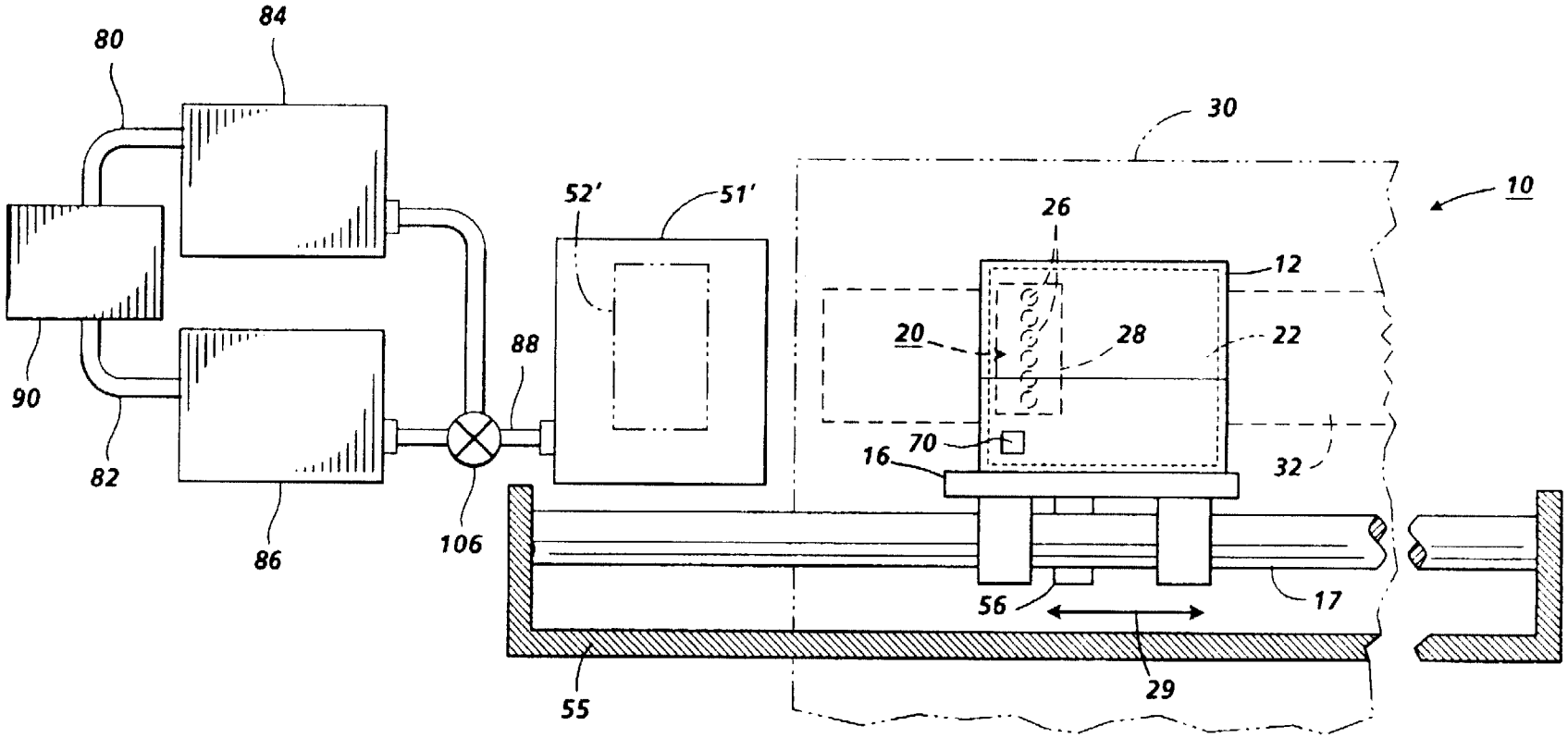
FIG. 5 is a schematic view of an ink jet printing system which incorporates a maintenance station which has been modified to include a refill station.

In a second embodiment of the invention, the refill operation is enabled by modifying an already existing maintenance station to selectively enable a refill operation. FIG. 5 shows the printer 10 of FIG. 1 with the refill function being accomplished in a modified maintenance station 51'. Capping mechanism 52' is as disclosed in the '111 patent but is modified as described below to selectively enable a refill operation. Two-way pump 90 is connected by tubes 80, 82 to waste ink container 84 or refill ink container 86, respectively. Tube 88 connects the capping assembly to either receptacle 84 or refill container 86 depending on the position of two-way valve 106. Under control of controller 74, either a maintenance (prime/capping) or a refill operation will be initiated. If a maintenance operation, printhead 12 is brought into sealing engagement with a gasket and two-way pump 90 will establish a vacuum and prime the printhead to draw and cause ink to be ejected from the nozzles and collect in receptacle 84. If a refill operation is initiated, pump 90 is converted to a pressure pump and forces ink from container 86 (which has been provided with a refill ink supply) through tube 88 and through nozzles 26 back into the printhead reservoir 22.

Figure 6:
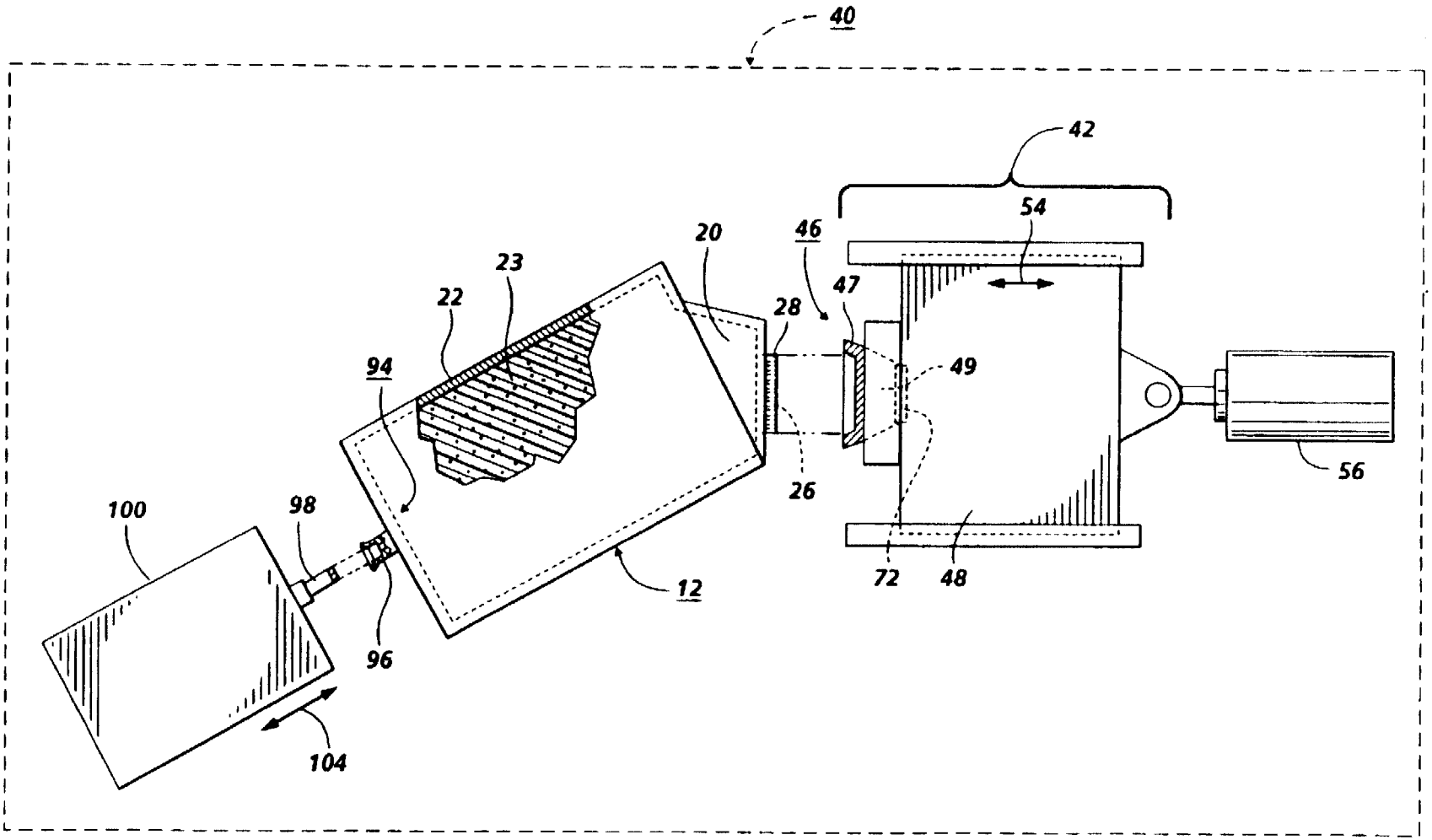
FIG. 6 is a schematic end view of a second embodiment of the printing cartridge at a refill station.

In a variation of the FIG. 2 embodiment, the printhead cartridge can be refilled by an alternate automatic mode of operation wherein a refill assembly is operated on vacuum principles. FIG. 6 shows a side view of a refill station 40 where a refill assembly 42' comprises sealing assembly 46 and refill container 48. These components are as described in connection with the FIG. 2 embodiment. Printhead 12 is modified by addition of a dual function vent 94.

Vent 94 is formed within the cartridge 12 wall. A flanged vent tube 96 is located in vent 94 with one end extending into reservoir 22 and the other end extending slightly beyond the wall cartridge into the ambient. Vent tube 96 has a perforated end cap to permit air flow and contains a barrier member which can be Gortex™ or similar material which permits the passage of air but prevents liquid ink flow out of the cartridge under normal operating conditions.

As in the FIG. 2 embodiment, when the printhead 12 is moved to refill station 40, gasket 47 interfaces with the surface of nozzle face 28 and encompasses nozzles 26, when the assembly 42 is automatically moved in the direction of arrow 94 by operation of solenoid 56. Apparatus 42 further includes a vacuum assembly 100 which may be a syringe-type vacuum suction mechanism. Mechanism 100 has a tube 98 terminating in a permeable gasket.

Mechanism 100 is activated to move towards the printhead in the direction of arrow 106. Tube 98 envelopes the end of flanged vent tube 96 and forms a leak-proof sealing engagement which is permeable to air. Mechanism 100 is operated by well known principles to apply a (negative) vacuum pressure through the vent tube 96 to the cartridge reservoir sufficient to draw ink from container 48 through nozzles 26. A vacuum of 200–250 Torr has been found to produce satisfactory results.

As ink begins to flow from container 46 through nozzles 26, the ink flows in a path opposite to the capillary flow of ink during normal operation; e.g. the ink flows through ink channels and begins to refill reservoir 22. The refill operation continues until the reservoir is filled to the desired level at which time mechanism 100 is de-energized and moved out of sealing contact with the cartridge. Assembly 42 is moved out of sealing engagement with the printhead nozzle face 28. The cartridge is then restored to the normal operating location.

While the embodiment disclosed herein is preferred, it will be appreciated from this teaching that various alternative, modifications, variations or improvements therein may be made by those skilled in the art, which are intended to be encompassed by the following claims:

What is claimed is:

1. An automated system for refilling ink jet cartridges in an ink jet printing system wherein a printhead and associated ink supply reservoir comprising the cartridge are moved on a carriage through a print zone with ink being ejected from nozzles formed in a nozzle face of the printhead, the system further including:

means for moving said cartridge to a refill station located outside of said print zone, means at said refill station for sealingly engaging an ink refill container with said nozzle face, means to force ink from said refill container through said printhead nozzles and into the associated ink supply reservoir thereby refilling said reservoir and means for moving said cartridge out of said refill station.

2. The system of claim 1 further including a maintenance station located outside the print zone and wherein said refill station is located in said maintenance station.

3. The system of claim 2 wherein said maintenance station includes at least a capping assembly including a sealing mechanism for sealingly engaging the nozzle face, an ink container for collecting waste ink ejected from the printhead nozzles during a priming mode of operation, a pump operating in a first mode to establish a vacuum against the nozzle face to cause ink droplets to be expelled therefrom into said ink container and in a second mode to force ink from said refill container through said nozzles into said cartridge reservoir and control means for selecting said first or second modes, said control means changing the function of said pump from a vacuum pump to a pressure pump, respectively.

4. The system of claim 1 wherein said means for forcing ink from said refill container is a pressure pump connected to said reservoir.

5. A method for automatically refilling an ink reservoir located within a printhead cartridge, the cartridge mounted on a carriage which is moved through a print zone, the method including the steps of:

moving the carriage to a refill station outside the print zone, establishing a sealing interface between a source of refill ink and the nozzle face of said printhead, forcing the ink from said refill ink source through the printhead nozzles and into said reservoir for a period of time sufficient to refill the reservoir and moving the carriage out of the refill station.

6. The system of claim 1 wherein said means for forcing ink from said refill container is a vacuum suction mechanism connected to said reservoir.

* * * * *